US011600454B2

(12) United States Patent
Coughlin et al.

(10) Patent No.: US 11,600,454 B2
(45) Date of Patent: Mar. 7, 2023

(54) CONTACT ASSEMBLY FOR ELECTRICAL DEVICES AND METHOD FOR MAKING

(71) Applicant: ABB Schweiz AG, Baden (CH)

(72) Inventors: Katherine Marjorie Coughlin, West Hartford, CT (US); Leonardo Ajdelsztajn, Niskayuna, NY (US); Jeffrey Jon Schoonover, Albany, NY (US); Samuel Stephen Kim, West Hartford, CT (US); Linda Yvonne Jacobs, West Hartford, CT (US); Maxime Michel Pean, West Hartford, CT (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/600,455

(22) Filed: Oct. 12, 2019

(65) Prior Publication Data

US 2020/0043675 A1 Feb. 6, 2020

Related U.S. Application Data

(62) Division of application No. 15/381,514, filed on Dec. 16, 2016, now Pat. No. 10,446,336.

(51) Int. Cl.
*H01H 1/021* (2006.01)
*C23C 24/04* (2006.01)
(Continued)

(52) U.S. Cl.
CPC ..... *H01H 1/021* (2013.01); *C23C 24/04* (2013.01); *H01H 1/025* (2013.01); *H01H 1/0233* (2013.01); *H01H 11/048* (2013.01)

(58) Field of Classification Search
CPC ..... H01H 1/021; H01H 1/023; H01H 1/0233; C23C 24/04
See application file for complete search history.

(56) References Cited

U.S. PATENT DOCUMENTS 5,565,235 A 10/1996 Baudrand et al.
5,670,418 A 9/1997 Ghosal
(Continued)

FOREIGN PATENT DOCUMENTS

CN 102286740 A * 12/2011
CN 102286740 A 12/2011
(Continued)

OTHER PUBLICATIONS

CN102286740A, machine translation. (Year: 2011).*
(Continued)

*Primary Examiner* — Robert A Vetere
(74) *Attorney, Agent, or Firm* — Armstrong Teasdale LLP

(57) ABSTRACT

A contact assembly for an electrical device and a method for making such an assembly are presented. The contact assembly comprises a substrate and a contact material disposed on the substrate. The contact material comprises a composite material comprising a refractory material and a matrix material. The matrix material has a higher ductility than the refractory material. The composite material further comprises a core region and an outer region bounding the core region, the core region having a higher concentration of the refractory material than the outer region. The method applies cold spraying a blended feedstock to produce a layer that includes the composite material described above.

19 Claims, 2 Drawing Sheets

(51) Int. Cl.

| | |
|---|---|
| ***H01H 11/04*** | (2006.01) |
| ***H01H 1/0233*** | (2006.01) |
| ***H01H 1/025*** | (2006.01) |

(56) References Cited

U.S. PATENT DOCUMENTS

| | | | | |
|---|---|---|---|---|
| 5,738,530 | A | 4/1998 | Schreiber et al. | |
| 6,685,988 | B2 | 2/2004 | Van Steenkiste et al. | |
| 7,230,304 | B2 | 6/2007 | Kikuchi et al. | |
| 7,282,679 | B2 | 10/2007 | Reichinger | |
| 7,758,916 | B2 | 7/2010 | Schmid et al. | |
| 8,034,195 | B2 | 10/2011 | Schmid et al. | |
| 9,928,971 | B2 | 3/2018 | Johansson et al. | |
| 2006/0093736 | A1* | 5/2006 | Raybould | C23C 28/028 427/180 |
| 2006/0093888 | A1* | 5/2006 | Vyas | C23C 24/04 429/518 |
| 2011/0103999 | A1* | 5/2011 | Oguri | C23C 24/04 420/469 |
| 2011/0143039 | A1* | 6/2011 | Jakimov | C23C 24/04 427/422 |
| 2011/0223053 | A1* | 9/2011 | Jahedi | B22F 3/115 419/66 |
| 2012/0304300 | A1 | 11/2012 | Labumbard | |
| 2012/0305300 | A1* | 12/2012 | Bourda | C23C 24/04 174/257 |
| 2014/0227551 | A1 | 8/2014 | Rateiczak et al. | |
| 2015/0048054 | A1 | 2/2015 | Karkada et al. | |
| 2015/0170846 | A1* | 6/2015 | Nayak | H01H 1/025 200/265 |

FOREIGN PATENT DOCUMENTS

| | | | |
|---|---|---|---|
| CN | 102782787 | A | 11/2012 |
| CN | 102763183 | B | 3/2015 |
| CN | 106233409 | A | 12/2016 |
| JP | 2006151844 | A | 6/2006 |
| JP | 2010222261 | A | 10/2010 |
| JP | 2014007041 | A | 1/2014 |
| WO | 2014073306 | A | 5/2014 |
| WO | 2016013735 | A | 1/2016 |

OTHER PUBLICATIONS

Dykhuizen et al., "Gas Dynamic Principles of Cold Spray," 1998, J. Thermal Spray Tech., vol. 7, pp. 205-212. (Year: 1998).*

Rolland et al., "Lifetime of Cold-Sprayed Electrical Contacts," Proceedings of ICEC-ICREPEC2012, 26th International Conference on Electrical Contacts (ICEC 2012), pp. 338-345, May 14-17, 2012.

V.K.Murugan et al., "An investigation into different nickel and nickel-phosphorus stacked thin coatings for the corrosion protection of electrical contacts," Surface and Coatings Technology, vol. 300, pp. 95-103, May 9, 2016.

Supplemental Search Report issued in Chinese Application No. 201711360686.5, dated Dec. 3, 2021, 1 page.

* cited by examiner

CONTACT ASSEMBLY FOR ELECTRICAL DEVICES AND METHOD FOR MAKING

CROSS-REFERENCE TO RELATED APPLICATION

This application is a divisional of U.S. patent application Ser. No. 15/381,514, filed Dec. 16, 2016, the entire disclosure of which is incorporated herein by reference.

TECHNICAL FIELD

This disclosure generally relates to electrical contact assemblies and methods for making these; more particularly, this disclosure relates to methods for making electrical contact assemblies for devices such as electrical switches, circuit breakers, contactors, and relays.

BACKGROUND

Contacts and contact assemblies are well known in the art of circuit breakers. Contact assemblies having electrical contacts for making and breaking an electrical current are not only employed in electrical circuit breakers, but also in other electrical devices, such as rotary double break circuit breakers, contactors, relays, switches, and disconnects. The applications for these electrical devices include, but are not limited to, the utility, industrial, commercial, residential, and automotive industries.

The primary function of a contact assembly is to provide a carrier for an electrical contact that is capable of being actuated to separate the contact from a second contact, thereby enabling the making and breaking of an electrical current in an electric circuit. Electrical contacts suitable for the noted applications often include silver, to carry the bulk of the electrical current, and in many cases a refractory material, such as tungsten, nickel, molybdenum, or tungsten carbide, to provide resistance to erosion and impact wear, or graphite to provide resistance to welding of contacts while maintaining low electrical resistance.

The contact is generally bonded to a substrate, such as a contact arm, which is typically, but not necessarily, copper or a copper alloy, in such a manner that the assembly tolerates the thermal, electrical and mechanical stresses experienced during operation of the host device. Failure of contacts often occurs at least in part due to wear from impact and erosion from electrical arcing. Factors that normally contribute to contact degradation include configuration or geometry of contact (different layer/thickness), materials choice, and processing (brazing/welding) defects that may create voids at the interface between the contact and its substrate, which degrades heat transfer from contact to substrate and, independently or additionally, can lead to separation of the contact from the substrate. Hence there is a need for improved fabrication of contact assemblies having suitable wear and erosion resistance and a high-quality interface joining the substrate and the contact.

SUMMARY

Embodiments of the present invention are provided to meet this and other needs. One embodiment is a contact assembly for an electrical device. The contact assembly comprises a substrate and a contact material disposed on the substrate. The contact material comprises a composite material comprising a refractory material and a matrix material. The matrix material has a higher ductility than the refractory material. The composite material further comprises a core region and an outer region bounding the core region, the core region having a higher concentration of the refractory material than the outer region.

Another embodiment is a method for fabricating a contact assembly for an electrical device. The method comprises axially feeding a powder feedstock into a gas stream of a cold spray deposition apparatus, wherein the feedstock comprises a first powder comprising a refractory material and a second powder comprising a matrix material, the matrix material having a higher ductility than the refractory material; and directing the gas stream and entrained feedstock through a nozzle onto a substrate to dispose the feedstock on the substrate in a continuous layer, wherein the entrained feedstock remains substantially solid, and wherein the layer comprises a composite material having a core region and an outer region bounding the core region, the core region having a higher concentration of the refractory material than the outer region.

BRIEF DESCRIPTION OF THE DRAWINGS

These and other features, aspects, and advantages of the present invention will become better understood when the following detailed description is read with reference to the accompanying drawing in which like characters represent like parts, wherein.

DETAILED DESCRIPTION OF THE DRAWINGS

Figure 1:
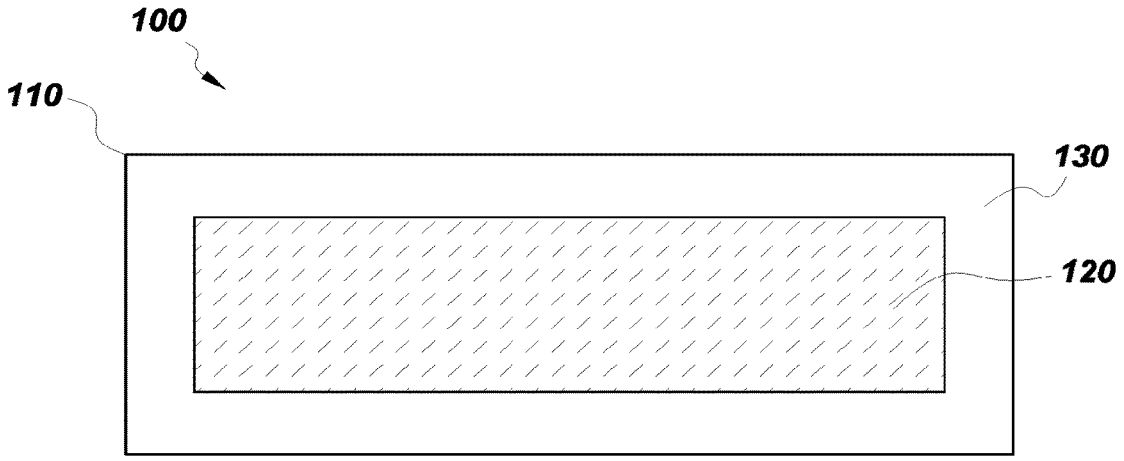
FIG. 1 is a schematic cross-sectional view of a layer having a structure formed in some embodiments of the present invention.

Approximating language, as used herein throughout the specification and claims, may be applied to modify any quantitative representation that could permissibly vary without resulting in a change in the basic function to which it is related. Accordingly, a value modified by a term or terms, such as "about", and "substantially" is not to be limited to the precise value specified. In some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

In the following specification and the claims, the singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable.

In one embodiment of the present invention, a method for fabricating a contact assembly for an electrical device includes a cold spray deposition process to spray a powder blend directly onto a substrate, for example, a copper-bearing substrate such as a contact arm or circuit breaker stab blade. The resulting contact material is dense, well bonded to the substrate, and has demonstrated attractive test results. Moreover, the technique for depositing the material results in a deposit having a unique and advantageous structure. The method may improve yield and reduce manufacturing cost while maintaining quality relative to existing fabrication processes involving powder compaction and brazing steps.

In a cold spray deposition process, particles of a powder feedstock are mixed with a gas and the gas and particles are subsequently accelerated into a supersonic jet, while the gas and particles are maintained at a sufficiently low temperature to prevent melting and undue oxidation of the particles. Typical cold spray methods use a cold spray deposition apparatus, generally a spray gun, that receives a high-pressure gas such as, for example, helium, nitrogen, or air, and a feedstock material, such as, for example, metals, refractory metals, alloys, or composite materials in powder form. The powder granules are introduced at a high pressure into a gas stream in the spray gun and emitted from a nozzle. The particles are accelerated to a high velocity in the gas stream that may reach a supersonic velocity. The gas stream may be heated. Typically, the gases are heated to less than the melting point of the particles to minimize in-flight oxidation and phase changes in the deposited material. Because of the relatively low deposition temperatures and very high velocities, cold spray processes offer the potential for depositing well-adhering, metallurgically bonded, dense, hard and wear-resistant coatings whose purity depends primarily on the purity of the feedstock powder used.

In accordance with one embodiment of the present invention, a method for fabricating a contact assembly for an electrical device includes axially feeding a powder feedstock into a gas stream of a cold spray deposition apparatus. As used herein, "axially feeding" means that the powder feedstock is introduced into the gas steam in a direction substantially parallel to the flow of the gas stream. Axial feeding may reduce the tendency of the powder to separate by size and/or density while traveling within the gas stream, relative to radial feeding, where powder is fed from the outer periphery of the gas stream in a direction substantially perpendicular to the flow direction. Reducing the tendency for feedstock powder to separate in this manner may provide for a higher quality deposit.

The gas stream has characteristics indicative of the cold spray process. For example, the gas stream may include one or more gases commonly used in cold spray processing, such as helium, nitrogen, or air. The gas pressure used to generate the gas stream is generally above 1.5 megapascals, such as above 2 megapascals. In some embodiments, the pressure is at least 3 megapascals. Gas stream velocity—and therefore the velocity of feedstock entrained in the gas stream—tends to increase with increasing pressure; as high feedstock velocity is desirable to enhance bonding of the particles within the deposit, high pressures are typically desired in embodiments of the present invention. Typical velocities for this process may be greater than 500 meters per second and in some embodiments up to about 1000 meters per second.

Processing parameters are selected to provide a dense, well-adhered deposit having the characteristics described in this disclosure. For instance, the distance from the spray gun to the substrate is set to allow the entrained feedstock to accelerate to a desired velocity range and (in some cases) temperature, to allow for a desired level of deformation to occur upon particle impact with the substrate, thereby enhancing adhesion, cohesion, and deposit density. In some embodiments, this distance is at least about 10 mm. In certain embodiments, the distance is up to about 50 mm. In particular embodiments, the distance is in a range from 10 mm to about 50 mm. The spray gun typically includes a heater disposed to heat the gas stream so that the temperature of the feedstock particles can be within a desired range at impact. The choice of gas temperature depends in part on the nature of the particles, the type of gas being used, the gas stream velocity, and the time the particles spend in the gas stream prior to impact. As noted previously, some amount of heating of the particles may be desirable to enhance plastic deformation upon impact, but the amount of heating is generally limited to avoid undesirable levels of oxidation in the feedstock and to maintain the feedstock substantially solid during its time within the gas flow. "Substantially solid" here means that the feedstock remains predominantly solid, but an incidental amount of particle melting, such as a small number of fine particles, may be acceptable if it does not adversely affect the properties of the deposit. In some embodiments, the gas temperature is at least 300 degrees Celsius. In some embodiments, the gas temperature is up to 800 degrees Celsius.

The selection of the feedstock material reflects the desire to deposit a material having electrical and mechanical properties suitable to provide a high-quality electrical contact assembly. Of course, the particular specification of electrical and mechanical properties for the contact assembly may vary depending on the application; for example, electrical conductivity of the contact can vary over an order of magnitude among the various applications within the scope of this disclosure. Generally, the feedstock includes a first component that includes a refractory material, to provide wear and erosion resistance, and a second component that comprises a material that has a higher ductility than the refractory material. Examples of a suitable refractory material include, without limitation, metallic tungsten, a carbide (such as tungsten carbide), graphite or other form of carbon, or a nitride. The material (referred to herein as "matrix material") included in the second component generally provides a high electrical conductivity relative to the refractory material, and its comparatively high ductility allows this matrix material to provide much of the adhesive and cohesive strength of the deposit. In some embodiments, the matrix material has an electrical conductivity of at least $3\times10^7$ siemens per meter to ensure a high level of conductivity in the deposit. Examples of suitable matrix materials include, without limitation, silver, copper, gold, aluminum, or a combination including one or more of the foregoing metals. An example feedstock that has shown good results in testing includes tungsten as a refractory material and further includes silver as a matrix material.

The feedstock may be provided in any of several different forms. For example, in one embodiment, the feedstock is fed as a blend, that is, feedstock is introduced to the gas stream as a mixture of a first powder comprising the refractory material and the second powder comprising the matrix material. As an example, a tungsten powder may be mechanically blended with a silver powder to create a blended feedstock, which may then be used in the method described herein, for example by feeding to the gas stream using a single powder feeder. Alternatively, the various components of the feedstock may be separately fed to the gas stream. In these embodiments, the components may become sufficiently intermixed during their time in the gas stream to provide a desired degree of compositional uniformity in the resulting deposit. As an example, a first powder comprising tungsten may be fed to the gas stream using a first powder feeder and a second powder comprising silver may be fed to the gas stream using a second powder feeder. In yet another alternative, the powder may have a core/shell structure, wherein one component of the feedstock is at the core of the particle with the other component disposed on the core, for example as a shell surrounding the core or as a group of smaller particles agglomerated around the core. As an example, a feedstock may comprise a plurality of particles, the particles comprising a core/shell structure in which, in a typical particle, tungsten is at the core and a shell comprising silver is disposed over the core.

The powder particles may be of any shape that allows efficient deposition. Spherical particles formed by gas atomization are one example, but non-spherical powders, such as those formed from chemical reduction processes, or by mechanically crushing, may also be suitable. The size of the powder particles used as the feedstock may be selected to provide desirable properties in the resulting deposit, as is typical in any application of the cold spray process. Typically the particle diameters are below 100 micrometers. In some embodiments, the median particle size is below 50 micrometers. The first powder and second powder need not be of similar size. For instance, in some embodiments, the first powder has a median size less than about 15 micrometers, while the second powder has a median size less than about 40 micrometers. In particular embodiments, the size distribution of the first powder is controlled to reduce or minimize the number of very large refractory particles (for example, particles with diameters larger than twice the median size), which may provide difficulties with forming and/or maintaining a strong bond to the matrix material in the deposit.

The relative proportions of the refractory material and matrix material are selected to provide the desired structure and properties for the resulting deposit. These proportions will depend in part on the nature of the materials selected and the deposition parameters used to produce the deposit. For example, in some embodiments, the refractory material makes up at least 50 percent by weight of the feedstock fed to the gas stream (either as a blend or fed separately as described previously). Where the refractory material includes a material with high atomic weight, such as tungsten, the mass fraction of the first powder may be even higher, such as at least 60 percent. However, as the proportion of refractory material increases, deposition efficiency may decrease as the amount of the softer matrix material, such as silver, for instance, becomes insufficient to effectively bind the refractory material within the deposit. In some embodiments, the feedstock comprises less than 90 percent by weight of the refractory material, and in particular embodiments the feedstock comprises less than 80 percent by weight of the refractory material. Depending on the application, refractory content of the feedstock may be even lower, such as where the feedstock comprises less than 50 percent by weight of the refractory material, such as less than 20 percent by weight.

The gas stream and the entrained feedstock are directed through a nozzle onto a substrate to dispose the feedstock in a continuous layer over the substrate. The nozzle may be of any suitable configuration consistent with the cold spray process to provide a deposit of the desired form on the substrate. For example, the shape of the nozzle may be configured to provide a plume of particles suitable to deposit the particles onto a substrate of a specified size at the gun-to-substrate distance chosen for the process.

The selection of feedstock and method of feeding it to the gas stream typically influences the microstructure of the resulting deposit. For instance, where the feedstock comprises first and second powders, whether in a pre-mixed blend or separately fed to the gas stream separately, the present inventors have generated a deposit having a unique structure, as illustrated in FIG. 1. In this structure, layer 100 includes a composite material 110 having a core region 120 and an outer region 130 bounding the core region 120. Core region 120 has a different composition than outer region 130. Specifically, the concentration of the refractory material is higher in the core region 120 than it is in the outer region 130. This is an unexpected structure and may be due at least in part to the nature of the feedstock; because the feedstock comprises separate populations of refractory particles and matrix material particles, the two populations may have different deposition efficiencies and different momentum transfer as they impact the substrate, resulting in a deposit having the noted structure.

In practice, as in other spray deposition processes the substrate and the spray gun move relative to one another to allow the layer to form over the desired surface of the substrate. The selected speed of this relative motion depends in part on a number of factors, such as the rate at which feedstock is fed to the gas stream, the shape of the particle plume within the gas stream (related to nozzle dimensions as noted previously), the deposition efficiency, and the desired thickness of the deposited layer. In some embodiments, the process parameters are tuned such that the desired layer structure can be deposited in as few passes as possible, such as where the entire layer is deposited in one pass.

Using the cold-spray-based method described above, a well-bonded, conductive, and mechanically durable contact material may be joined to contact arms or other switchgear components without the need for a brazing step as is typically used in conventional contact assembly fabrication processes.

Figure 2:
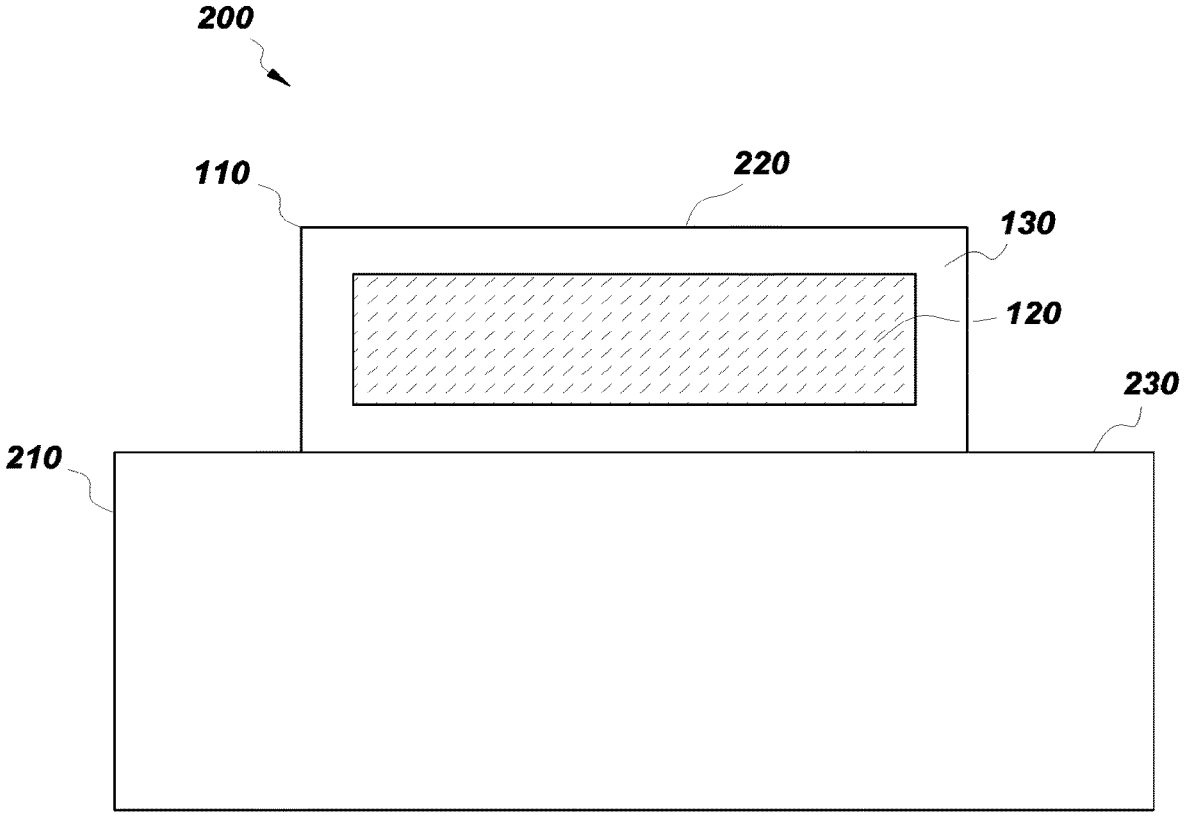
FIG. 2 is a schematic cross-sectional view of an article in accordance with some embodiments of the present invention.

A contact assembly for an electrical device that includes the uniquely structured composite material 110 described above is another embodiment of the present invention. Referring to FIG. 2, the contact assembly 200 includes a substrate 210 and a contact material 220 disposed on substrate 210. Substrate 210 typically includes an electrically conductive material, such as copper. In one embodiment, substrate 210 is a contact arm for an electrical circuit breaker.

Contact material 220 comprises composite material 110, which as noted previously includes a refractory material such as metallic tungsten, a carbide (such as tungsten carbide), graphite or other form of carbon, or a nitride; and a comparatively more ductile matrix material, such as a material that includes silver, copper, gold, or aluminum.

As discussed above, composite material 110 further comprises a core region 120 and an outer region 130 bounding core region 120, the core region 120 having a higher concentration of the refractory material than the outer region 130. One advantageous consequence of this unique structure is that the interface 230 between contact material 220 and substrate 210 is comparatively rich in the ductile, electrically conductive matrix material, thereby providing a strong, electrically conducting bond between substrate 210 and contact material 220. Moreover, having outer region 130 comparatively rich in matrix material may enhance the ability of the contact material 220 to dissipate heat beyond what that ability would be if more refractory material were present in this region. In some embodiments, the refractory material is present in outer region 130 at a concentration of less than 30 volume percent (such as where a concentration of matrix material is at least 70 volume percent). In certain embodiments, outer region 130 comprises the refractory material in a concentration range from 20 volume percent to 25 volume percent (such as where a concentration of matrix material is at least 75 volume percent). In particular embodiments, the contact material 220 present at interface 230 is substantially free of the refractory material, meaning that this material is substantially pure matrix material, such as silver, aside from incidental impurities, thus enhancing metallurgical bonding and electrical contact between contact material 220 and substrate 210.

Core region 120 provides mechanical strength and erosion resistance to contact material 220, generally due to the presence of the refractory material in higher proportion than is found in outer region 130. In some embodiments, core region 120 comprises the refractory material at a concentration of at least 30 volume percent relative to the total volume of composite material 110, and in particular embodiments, this concentration is at least 35 volume percent of the refractory material. Upper limits for concentration of refractory material in core region 120 are generally set by the required cohesion and electrical properties for the material; if the amount of matrix material becomes too low, the electrical conductivity of core region 120 may become unduly low, for example.

In one illustrative example, the refractory material component of composite material 110 includes tungsten, such as metallic tungsten, and the matrix material component comprises silver. In a specific embodiment, core region 120 comprises from 35 volume percent to 40 volume percent tungsten and from 60 volume percent to 65 volume percent silver; and outer region 130 comprises from 20 volume percent to 5 volume percent tungsten and from 75 volume percent to 80 volume percent silver.

Figure 3:
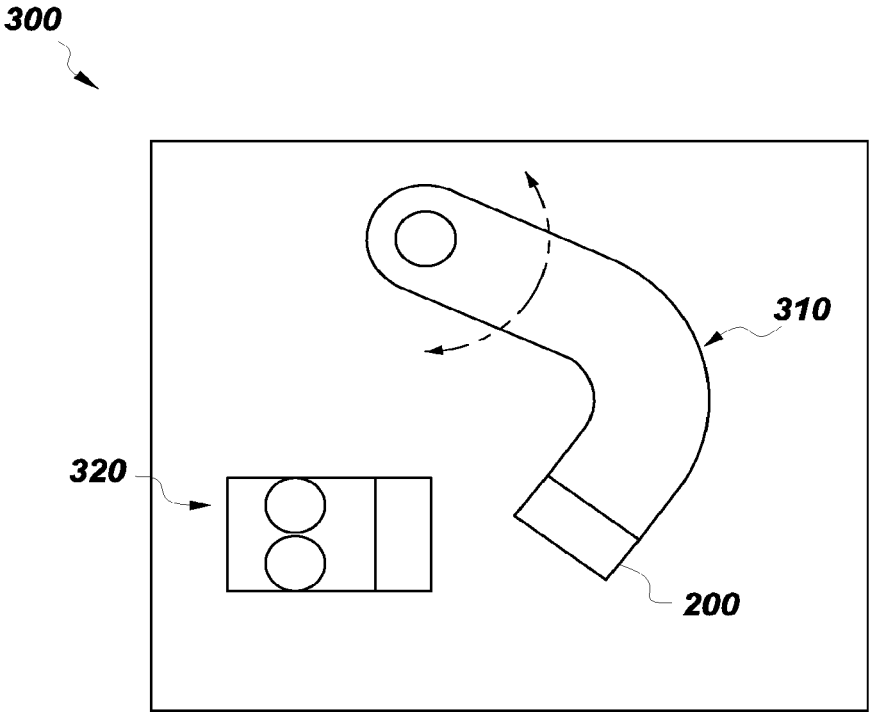
FIG. 3 is a schematic view of a device in accordance with some embodiments of the present invention.

Other embodiments of the present invention include any electrical device that includes contact assembly 200. Examples of such devices include circuit breakers, switches, and other components that require a durable, conductive contact assembly. As shown in FIG. 3, device 300 typically includes a first contact apparatus 310 and a second contact apparatus 320. In the illustrative embodiment shown, first contact apparatus 310 is movable and second contact apparatus 320 is stationary, but this arrangement is not necessary, as in some embodiments both contact apparatus may be movable. Either or both contact apparatus 310, 320 may be, or include, contact assembly 200 as described herein. In the illustrated embodiment, first contact apparatus 310 includes contact assembly 200.

The unique contact material 220 is readily distinguished from conventionally sintered and brazed contacts in a variety of ways. First, the cold spray process relies on cold welding to provide the bonds among particles, rather than diffusion bonding as occurs during sintering. Moreover, the bond between substrate 210 and contact material 220 is formed in the solid state, again through a cold-welding mechanism, and is substantially free of the brazed structure commonly used in conventional fabrication. Finally, the presence of the core region 120 and outer region 130 provides certain advantages as noted above, and is distinguished from the more homogeneously structured sintered contact material used in conventional processes.

EXAMPLES

The following examples are presented to further illustrate non-limiting embodiments of the present invention.

Pure tungsten powder having a nominal median size of about 10 micrometers was blended with pure silver powder having a nominal median size of about 30 micrometers. The resulting blend was fed to a cold spray gun operating with argon at pressure higher than 3 MPa and temperature of up to 800 C, and deposited on a copper substrate disposed up to 50 mm from the nozzle of the gun. The resulting deposit was observed to have a core region relatively enriched in tungsten, with an outer region of about 250 micrometers in thickness, and having a lower tungsten concentration than the core region, around the perimeter of the deposit. The density, mechanical properties, and electrical properties of the deposit were determined to be consistent with expectations for materials suitable for use as an electrical contact pad.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for fabricating a contact assembly for an electrical device, the method comprising:

axially feeding a powder feedstock into a gas stream of a cold spray deposition apparatus, wherein the powder feedstock comprises a mixture of two separate powders comprising (i) a first powder comprising a refractory material and (ii) a second powder comprising a matrix material, the matrix material having a higher ductility than the refractory material;

directing the gas stream and entrained powder feedstock through a nozzle onto a substrate; and depositing the entrained powder feedstock on the substrate in a continuous layer, wherein the continuous layer comprises a core region and an outer region bounding the core region, the core region having a first concentration of the refractory material, and the outer region having a second concentration of the refractory material, wherein the first concentration is higher than the second concentration.

2. The method of claim 1, wherein the gas stream is accelerated through the nozzle to a supersonic velocity.

3. The method of claim 1, wherein the refractory material is between 50-90 weight percent of the powder feedstock.

4. The method of claim 1, wherein the gas stream is heated to about 800 degrees Celsius.

5. The method of claim 1, wherein the refractory material comprises tungsten metal, and wherein the matrix material comprises silver.

6. The method of claim 1, wherein the substrate comprises a contact arm or circuit breaker stab blade.

7. The method of claim 1, wherein axially feeding comprises introducing the powder feedstock into the gas stream in a direction parallel to a flow of the gas stream.

8. The method of claim 1, wherein a pressure of the gas stream causes a velocity of the entrained powder feedstock to be greater than 500 meters per second when directed through the nozzle.

9. The method of claim 8, wherein the pressure of the gas stream causes the velocity of the powder feedstock to be greater than 1000 meters per second when directed through the nozzle.

10. The method of claim 1, further comprising:

receiving the first powder from a first feeder;

receiving the second powder from a second feeder; and blending the first powder and the second powder together prior to axially feeding the powder feedstock into the gas stream.

11. The method of claim 1, wherein the outer region of the continuous layer surrounds the core region of the continuous layer.

12. A method for a cold spray deposition apparatus, the method comprising:

axially feeding a powder feedstock into a gas stream of the cold spray deposition apparatus, wherein the powder feedstock comprises a mixture of two separate powders comprising (i) a first powder comprising a refractory material and (ii) a second powder comprising a matrix material, the matrix material having a higher ductility than the refractory material;

directing the gas stream and entrained powder feedstock through a nozzle of the cold spray deposition apparatus onto a substrate; and depositing the entrained powder feedstock on the substrate in a continuous layer, such that a temperature of at least a portion of particles of the powder feedstock is less than a melting point of the particles, wherein the continuous layer comprises a core region and an outer region bounding the core region, the core region having a first concentration of the refractory material, and the outer region having a second concentration of the refractory material, wherein the first concentration is higher than the second concentration.

13. The method of claim 12, wherein the refractory material comprises tungsten metal, and wherein the matrix material comprises silver.

14. The method of claim 12, further comprising disposing the nozzle with respect to the substrate such that the entrained powder feedstock achieves a supersonic speed when directed through the nozzle.

15. The method of claim 14, wherein disposing the nozzle with respect to the substrate includes disposing the nozzle at least 10 millimeters away from the substrate.

16. The method of claim 15, wherein disposing the nozzle with respect to the substrate includes disposing the nozzle up to 50 millimeters away from the substrate.

17. The method of claim 12, wherein the refractory material is between 50-90 weight percent of the powder feedstock.

18. The method of claim 12, wherein the substrate comprises a contact arm or circuit breaker stab blade.

19. The method of claim 12, further comprising:

receiving the first powder from a first feeder;

receiving the second powder from a second feeder; and blending the first powder and the second powder together prior to axially feeding the powder feedstock into the gas stream.

* * * * *